US009152132B2

(12) United States Patent
Sano et al.

(10) Patent No.: US 9,152,132 B2
(45) Date of Patent: Oct. 6, 2015

(54) TIME INFORMATION OBTAINING DEVICE AND RADIO-CONTROLLED TIMEPIECE

(71) Applicant: CASIO COMPUTER CO., LTD., Tokyo (JP)

(72) Inventors: Takashi Sano, Fussa (JP); Haruo Kajitani, Akiruno (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 8 days.

(21) Appl. No.: 13/926,804

(22) Filed: Jun. 25, 2013

(65) Prior Publication Data

US 2014/0036641 A1 Feb. 6, 2014

(30) Foreign Application Priority Data

Jul. 31, 2012 (JP) ..... 2012-169786

(51) Int. Cl.

| | |
|---|---|
| ***G04R 20/10*** | (2013.01) |
| ***G04R 20/12*** | (2013.01) |
| ***G04R 20/08*** | (2013.01) |
| ***G04G 7/00*** | (2006.01) |
| *G04R 20/00* | (2013.01) |

(52) U.S. Cl.

CPC *G04R 20/12* (2013.01); *G04G 7/02* (2013.01); *G04R 20/08* (2013.01); *G04R 20/10* (2013.01); *G04R 20/00* (2013.01)

(58) Field of Classification Search

CPC ..... G04R 20/06; G04R 20/08; G04R 20/12; G04R 20/18; G04R 20/24; G04R 20/30

USPC ..... 368/47

See application file for complete search history.

(56) References Cited

U.S. PATENT DOCUMENTS

| | | | | |
|---|---|---|---|---|
| 2006/0050824 | A1* | 3/2006 | Kondo | 375/354 |
| 2006/0140282 | A1* | 6/2006 | Kondo | 375/242 |
| 2009/0323478 | A1* | 12/2009 | Someya | 368/47 |
| 2011/0255377 | A1* | 10/2011 | Abe | 368/47 |
| 2012/0026841 | A1* | 2/2012 | Tokiwa et al. | 368/47 |
| 2012/0026842 | A1* | 2/2012 | Tokiwa et al. | 368/47 |
| 2012/0134241 | A1* | 5/2012 | Nomura et al. | 368/47 |

FOREIGN PATENT DOCUMENTS

JP 11-304973 A 11/1999

* cited by examiner

*Primary Examiner* — Amy Cohen Johnson
*Assistant Examiner* — Daniel Wicklund
(74) *Attorney, Agent, or Firm* — Holtz, Holtz, Goodman & Chick PC

(57) ABSTRACT

A time information obtaining device and a radio-controlled timepiece are shown. According to one implementation, the time information obtaining device includes a receiving section, a code identifying section, a decoding section, and a consistency confirming section. The consistency confirming section confirms consistency of time information. The consistency confirming section generates the selected code string using the following: (i) a matching selected code string portion in which, for a code string portion including a code which may change according to the time information, a type of code is selected based on a degree of match between an identified code string and a model code string; and (ii) a majority selected code string portion in which, for a portion other than the above, a type of code is selected by majority determination among the codes identified to be a same position.

12 Claims, 6 Drawing Sheets

FIG. 2A

| SECOND | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 |
|---|---|---|---|---|---|---|---|---|---|---|---|---|---|---|---|---|---|---|---|---|---|---|---|---|---|---|---|---|---|---|
| JJY | P | 40m | 20m | 10m | 0 | 8m | 4m | 2m | 1m | P1 | 0 | 0 | 20h | 10h | 0 | 8h | 4h | 2h | 1h | P2 | 0 | 0 | 200d | 100d | 0 | 80d | 40d | 20d | 10d | P3 |
| | MARKER | TEN MINUTE UNIT DIGIT | | | EX-TENDED | ONE MINUTE UNIT DIGIT | | | | MARKER | EX-TENDED | | TEN HOUR UNIT DIGIT | | EX-TENDED | ONE HOUR UNIT DIGIT | | | | MARKER | EX-TENDED | | HUNDRED DAY UNIT DIGIT | | EX-TENDED | TEN DAY UNIT DIGIT | | | | MARKER |

| SECOND | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 |
|---|---|---|---|---|---|---|---|---|---|---|---|---|---|---|---|---|---|---|---|---|---|---|---|---|---|---|---|---|---|---|
| JJY | 8d | 4d | 2d | 1d | 0 | 0 | PA1 | PA2 | SU1 | P4 | SU2 | 80y | 40y | 20y | 10y | 8y | 4y | 2y | 1y | P5 | 4w | 2w | 1w | LS1 | LS2 | 0 | 0 | 0 | 0 | P0 |
| | ONE DAY UNIT DIGIT | | | | EX-TENDED | | HOUR P | MINUTE P | | MARKER | | TEN YEAR UNIT DIGIT | | | | ONE YEAR UNIT DIGIT | | | | MARKER | DAY OF WEEK | | | LEAP SECOND | | EXTENDED | | | | MARKER |

FIG. 2B

2010/10/15 11:00

| SECOND | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 |
|---|---|---|---|---|---|---|---|---|---|---|---|---|---|---|---|---|---|---|---|---|---|---|---|---|---|---|---|---|---|---|
| TRANSMISSION | P | 0 | 0 | 0 | 0 | 0 | 0 | 0 | 0 | P | 0 | 0 | 0 | 1 | 0 | 0 | 0 | 0 | 1 | P | 0 | 0 | 1 | 0 | 0 | 1 | 0 | 0 | 0 | P |
| RECEPTION | P | 0 | 0 | 0 | 0 | 0 | 0 | 0 | 0 | P | 0 | 0 | 0 | 1 | 0 | 0 | 0 | 0 | 1 | P | 0 | 0 | 1 | 0 | 0 | 1 | 0 | 0 | 0 | P |
| CONSISTENCY | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |

| SECOND | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 |
|---|---|---|---|---|---|---|---|---|---|---|---|---|---|---|---|---|---|---|---|---|---|---|---|---|---|---|---|---|---|---|
| TRANSMISSION | 1 | 0 | 0 | 0 | 0 | 0 | 0 | 0 | 0 | P | 0 | 0 | 0 | 0 | 1 | 0 | 0 | 0 | 0 | P | 1 | 0 | 1 | 0 | 0 | 0 | 0 | 0 | 0 | P |
| RECEPTION | 1 | 0 | 0 | 0 | 0 | 0 | 0 | 0 | 0 | P | 0 | 0 | 0 | 0 | 1 | 0 | 0 | 0 | 0 | P | 1 | 0 | 0 | 0 | 0 | 0 | 0 | 0 | 0 | P |
| CONSISTENCY | ○ | ○ | ○ | ○ | ○ | ○ | ○ | ○ | ○ | ○ | ○ | ○ | ○ | ○ | ○ | ○ | ○ | ○ | ○ | ○ | ○ | ○ | × | ○ | ○ | ○ | ○ | ○ | ○ | ○ |

(p)

FIG. 2C

2010/10/15 11:01

(q)

| SECOND | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 |
|---|---|---|---|---|---|---|---|---|---|---|---|---|---|---|---|---|---|---|---|---|---|---|---|---|---|---|---|---|---|---|
| TRANSMISSION | P | 0 | 0 | 0 | 0 | 0 | 0 | 0 | 1 | P | 0 | 0 | 0 | 1 | 0 | 0 | 0 | 0 | 1 | P | 0 | 0 | 1 | 0 | 0 | 1 | 0 | 0 | 0 | P |
| RECEPTION | P | 0 | 0 | 0 | 0 | 0 | 0 | 0 | 1 | P | 0 | 0 | 0 | 1 | 0 | 0 | 0 | 0 | 1 | P | 0 | 1 | 1 | 0 | 0 | 1 | 0 | 0 | 0 | P |
| CONSISTENCY | ○ | ○ | ○ | ○ | ○ | ○ | ○ | ○ | ○ | ○ | ○ | ○ | ○ | ○ | ○ | ○ | ○ | ○ | ○ | ○ | ○ | × | ○ | ○ | ○ | ○ | ○ | ○ | ○ | ○ |

| SECOND | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 |
|---|---|---|---|---|---|---|---|---|---|---|---|---|---|---|---|---|---|---|---|---|---|---|---|---|---|---|---|---|---|---|
| TRANSMISSION | 1 | 0 | 0 | 0 | 0 | 0 | 0 | 1 | 0 | P | 0 | 0 | 0 | 0 | 1 | 0 | 0 | 0 | 0 | P | 1 | 0 | 1 | 0 | 0 | 0 | 0 | 0 | 0 | P |
| RECEPTION | 1 | 0 | 0 | 0 | 1 | 0 | 0 | 1 | 0 | P | 0 | 0 | 0 | 0 | 1 | 0 | 0 | 0 | 0 | P | 1 | 0 | 1 | 0 | 0 | 0 | 0 | 0 | 0 | P |
| CONSISTENCY | ○ | ○ | ○ | ○ | × | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |

(r)

FIG. 2D

2010/10/15 11:02

(s)

| SECOND | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 |
|---|---|---|---|---|---|---|---|---|---|---|---|---|---|---|---|---|---|---|---|---|---|---|---|---|---|---|---|---|---|---|
| TRANSMISSION | P | 0 | 0 | 0 | 0 | 0 | 0 | 1 | 0 | P | 0 | 0 | 0 | 1 | 0 | 0 | 0 | 0 | 1 | P | 0 | 0 | 1 | 0 | 0 | 1 | 0 | 0 | 0 | P |
| RECEPTION | P | 0 | 0 | 0 | 0 | 0 | 0 | 1 | 0 | P | 0 | 0 | 0 | 1 | 0 | 1 | 0 | 0 | 1 | P | 0 | 0 | 1 | 0 | 0 | 1 | 0 | 0 | 0 | P |
| CONSISTENCY | ○ | ○ | ○ | ○ | ○ | ○ | ○ | ○ | ○ | ○ | ○ | ○ | ○ | ○ | ○ | × | ○ | ○ | ○ | ○ | ○ | ○ | ○ | ○ | ○ | ○ | ○ | ○ | ○ | ○ |

| SECOND | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 |
|---|---|---|---|---|---|---|---|---|---|---|---|---|---|---|---|---|---|---|---|---|---|---|---|---|---|---|---|---|---|---|
| TRANSMISSION | 1 | 0 | 0 | 0 | 0 | 0 | 0 | 1 | 0 | P | 0 | 0 | 0 | 0 | 1 | 0 | 0 | 0 | 0 | P | 1 | 0 | 1 | 0 | 0 | 0 | 0 | 0 | 0 | P |
| RECEPTION | 1 | 0 | 0 | 0 | 0 | 0 | 0 | 1 | 0 | P | 0 | 1 | 0 | 0 | 1 | 0 | 0 | 0 | 0 | P | 1 | 0 | 1 | 0 | 0 | 0 | 0 | 0 | 0 | P |
| CONSISTENCY | ○ | ○ | ○ | ○ | ○ | ○ | ○ | ○ | ○ | ○ | ○ | × | ○ | ○ | ○ | ○ | ○ | ○ | ○ | ○ | ○ | ○ | ○ | ○ | ○ | ○ | ○ | ○ | ○ | ○ |

(t)

FIG. 2E

RESULT OF MAJORITY JUDGMENT

| SECOND | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 |
|---|---|---|---|---|---|---|---|---|---|---|---|---|---|---|---|---|---|---|---|---|---|---|---|---|---|---|---|---|---|---|
| TRANSMISSION | P | 0 | 0 | 0 | 0 | – | – | – | – | P | 0 | 0 | 0 | 1 | 0 | 0 | 0 | 0 | 1 | P | 0 | 0 | 1 | 0 | 0 | 1 | 0 | 0 | 0 | P |
| RECEPTION | P | 0 | 0 | 0 | 0 | – | – | – | – | P | 0 | 0 | 0 | 1 | 0 | 0 | 0 | 0 | 1 | P | 0 | 0 | 1 | 0 | 0 | 1 | 0 | 0 | 0 | P |
| CONSISTENCY | ○ | ○ | ○ | ○ | ○ | – | – | – | – | ○ | ○ | ○ | ○ | ○ | ○ | ○ | ○ | ○ | ○ | ○ | ○ | ○ | ○ | ○ | ○ | ○ | ○ | ○ | ○ | ○ |

| SECOND | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 |
|---|---|---|---|---|---|---|---|---|---|---|---|---|---|---|---|---|---|---|---|---|---|---|---|---|---|---|---|---|---|---|
| TRANSMISSION | 1 | 0 | 0 | 0 | 0 | 0 | 0 | 1 | 0 | P | 0 | 0 | 0 | 0 | 1 | 0 | 0 | 0 | 0 | P | 1 | 0 | 1 | 0 | 0 | 0 | 0 | 0 | 0 | P |
| RECEPTION | 1 | 0 | 0 | 0 | 0 | 0 | 0 | 1 | 0 | P | 0 | 0 | 0 | 0 | 1 | 0 | 0 | 0 | 0 | P | 1 | 0 | 1 | 0 | 0 | 0 | 0 | 0 | 0 | P |
| CONSISTENCY | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |

FIG. 3A

| SECOND | 5 | 6 | 7 | 8 | 5 | 6 | 7 | 8 | 5 | 6 | 7 | 8 |
|---|---|---|---|---|---|---|---|---|---|---|---|---|
| CODE | 0 | 0 | 0 | 0 | 0 | 0 | 0 | 1 | 0 | 0 | 1 | 0 |
| MINUTE | 0 | | | | 1 | | | | 2 | | | |

FIG. 3B

| SECOND | 5 | 6 | 7 | 8 | 5 | 6 | 7 | 8 | 5 | 6 | 7 | 8 |
|---|---|---|---|---|---|---|---|---|---|---|---|---|
| CODE | 0 | 0 | 0 | 1 | 0 | 0 | 1 | 0 | 0 | 0 | 1 | 1 |
| MINUTE | 1 | | | | 2 | | | | 3 | | | |

FIG. 3C

| SECOND | 5 | 6 | 7 | 8 | 5 | 6 | 7 | 8 | 5 | 6 | 7 | 8 |
|---|---|---|---|---|---|---|---|---|---|---|---|---|
| CODE | 0 | 0 | 1 | 0 | 0 | 0 | 1 | 1 | 0 | 1 | 0 | 0 |
| MINUTE | 2 | | | | 3 | | | | 4 | | | |

FIG. 3D

| SECOND | 5 | 6 | 7 | 8 | 5 | 6 | 7 | 8 | 5 | 6 | 7 | 8 |
|---|---|---|---|---|---|---|---|---|---|---|---|---|
| CODE | 0 | 0 | 1 | 1 | 0 | 1 | 0 | 0 | 0 | 1 | 0 | 1 |
| MINUTE | 3 | | | | 4 | | | | 5 | | | |

FIG. 3E

| SECOND | 5 | 6 | 7 | 8 | 5 | 6 | 7 | 8 | 5 | 6 | 7 | 8 |
|---|---|---|---|---|---|---|---|---|---|---|---|---|
| CODE | 0 | 1 | 0 | 0 | 0 | 1 | 0 | 1 | 0 | 1 | 1 | 0 |
| MINUTE | 4 | | | | 5 | | | | 6 | | | |

FIG. 3F

| SECOND | 5 | 6 | 7 | 8 | 5 | 6 | 7 | 8 | 5 | 6 | 7 | 8 |
|---|---|---|---|---|---|---|---|---|---|---|---|---|
| CODE | 0 | 1 | 0 | 1 | 0 | 1 | 1 | 0 | 0 | 1 | 1 | 1 |
| MINUTE | 5 | | | | 6 | | | | 7 | | | |

FIG. 3G

| SECOND | 5 | 6 | 7 | 8 | 5 | 6 | 7 | 8 | 5 | 6 | 7 | 8 |
|---|---|---|---|---|---|---|---|---|---|---|---|---|
| CODE | 0 | 1 | 1 | 0 | 0 | 1 | 1 | 1 | 1 | 0 | 0 | 0 |
| MINUTE | 6 | | | | 7 | | | | 8 | | | |

FIG. 3H

| SECOND | 5 | 6 | 7 | 8 | 5 | 6 | 7 | 8 | 5 | 6 | 7 | 8 |
|---|---|---|---|---|---|---|---|---|---|---|---|---|
| CODE | 0 | 1 | 1 | 1 | 1 | 0 | 0 | 0 | 1 | 0 | 0 | 1 |
| MINUTE | 7 | | | | 8 | | | | 9 | | | |

FIG. 3I

| SECOND | 5 | 6 | 7 | 8 | 5 | 6 | 7 | 8 | 5 | 6 | 7 | 8 |
|---|---|---|---|---|---|---|---|---|---|---|---|---|
| CODE | 1 | 0 | 0 | 0 | 1 | 0 | 0 | 1 | 0 | 0 | 0 | 0 |
| MINUTE | 8 | | | | 9 | | | | 0 | | | |

FIG. 3J

| SECOND | 5 | 6 | 7 | 8 | 5 | 6 | 7 | 8 | 5 | 6 | 7 | 8 |
|---|---|---|---|---|---|---|---|---|---|---|---|---|
| CODE | 1 | 0 | 0 | 1 | 0 | 0 | 0 | 0 | 0 | 0 | 0 | 1 |
| MINUTE | 9 | | | | 0 | | | | 1 | | | |

TIME INFORMATION OBTAINING DEVICE AND RADIO-CONTROLLED TIMEPIECE

BACKGROUND OF THE INVENTION

1. Field of the Invention

The present invention relates to a time information obtaining device and a radio-controlled timepiece.

2. Description of the Related Art

Conventionally, there is an electronic clock which obtains time information from an external source so as to be able to calibrate the time. The standard wave which transmits time information using a radio wave with a long wavelength range is one type of time information which the electronic clock is able to obtain from an external source.

As the standard wave, other than JJY transmitted in Japan, WWVB of the US, MSF of UK, and DCF77 of Germany are primarily used. In such standard wave, a signal showing time information of each minute is amplitude modulated with 60 seconds as one cycle (frame) and output. The signal showing time information is configured by a code string arranged according to a predetermined format determined by each standard wave transmission station, and the signal showing each code is output one for each second synchronized with the timing of the start of each second. In an electronic clock (radio-controlled timepiece) which performs calibration of time using the standard wave, after the signal is demodulated from the received standard wave, the signal is decoded according to the format to obtain information such as date and time.

The radio wave with the long wavelength range transmits throughout an extremely long distance on the surface of the Earth, and therefore, any one of the standard waves can be received throughout Japan and in a wide range throughout the world. However, the noise generated in the same frequency band is also superimposed on the signal of the standard wave and is transmitted throughout long distances. Further, the radio wave attenuates inside a building made of a steel frame or reinforced concrete, and this makes it difficult to favorably receive the radio wave. Therefore, from the past, many methods of enhancing receiving sensitivity, methods of demodulation, and methods of decoding have been developed to favorably read time information from the standard wave.

In a radio-controlled timepiece, in order to avoid misidentifying the code string from the received signal and obtaining inaccurate time information, processing is performed to obtain time information of a plurality of frames and the consistency is confirmed among the obtained pieces of time information. For example, Japanese Patent Application Laid-Open Publication No. H11-304973 divides each frame into blocks each showing year, date, day of the week, hour, and minute, confirms consistency of the time information among the plurality of frames for each block, and repeating the reception of the standard wave and the confirmation of consistency of the time information for the blocks which are inconsistent, until consistency is confirmed.

However, with conventional radio-controlled timepieces, if the reception strength of the standard wave is weak or the environment is full of noise, error judgment of the code increases, and it is difficult to confirm consistency of the time information among the plurality of frames. Therefore, obtaining the time information does not end.

The present invention is a time information obtaining device and a radio-controlled timepiece which can obtain time information without reducing the accuracy of the time information and without prolonging the time necessary to obtain the time information.

SUMMARY OF THE INVENTION

According to an aspect of the present invention, there is provided a time information obtaining device including:

a receiving section which receives a radio wave including time information and which demodulates a signal from the received radio wave;

a code identifying section which identifies a code string showing the time information from the signal demodulated by the receiving section;

a decoding section which decodes the identified code string to obtain time information; and a consistency confirming section which confirms consistency of time information shown in a plurality of code strings, wherein at least one of the plurality of code strings with which consistency is confirmed by the consistency confirming section is a selected code string generated by code strings consisting of a predetermined number which is at least 3 identified by the code identifying section; and the consistency confirming section generates the selected code string using the following:

(i) a matching selected code string portion in which, among the predetermined number of code strings, for a code string portion set in advance including a code which may change among code strings according to the time information of the code string, a type of code of a code string portion is selected based on a degree of match between an identified code string arranging the predetermined number of code string portions, and each of a model code string which is an array of the predetermined number of code string portions which are possible arrays as the identified code string; and (ii) a majority selected code string portion in which, among the predetermined number of code strings, for a portion other than the code string portion set in advance, a type of code is selected by majority determination among the predetermined number of codes identified to be a same position in the code string.

BRIEF DESCRIPTION OF THE DRAWINGS

The present invention and the above-described objects, features and advantages thereof will become more fully understood from the following detailed description with the accompanying drawings and wherein;

FIG. 2A to FIG. 2E are diagrams describing a code array of data of 1 frame of JJY, and diagrams describing a method of identifying the code based on data of a plurality of frames;

FIG. 3A to FIG. 3J are charts showing a model array pattern of a code showing a digit of one minute unit for 3 frames;

DETAILED DESCRIPTION OF THE PREFERRED EMBODIMENTS

Below, an embodiment of the present invention is described with reference to the drawings.

First Embodiment

Figure 1:
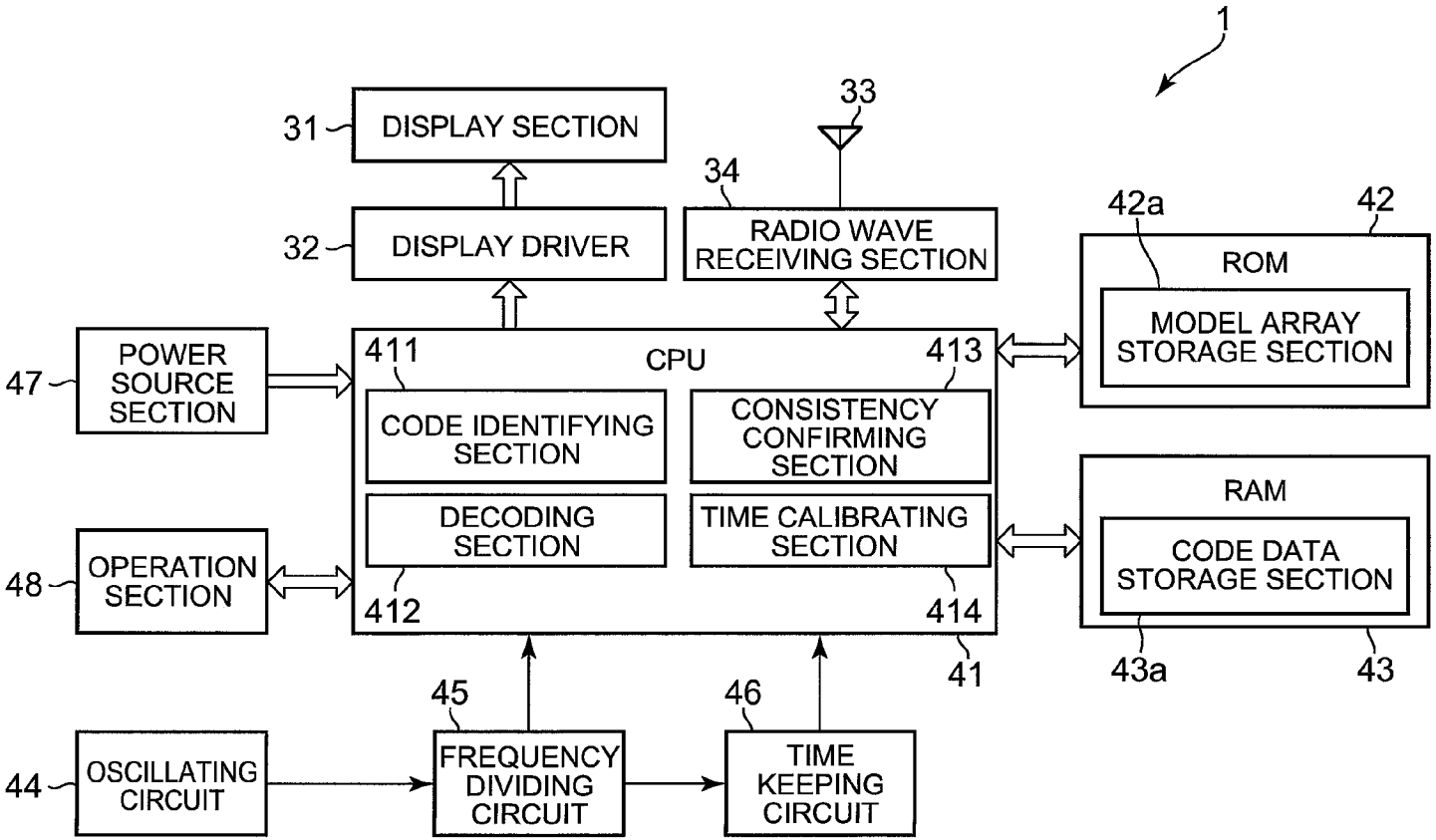
FIG. 1 is a block diagram showing an inner configuration of an electronic clock of an embodiment of the present invention.

FIG. 1 is a block diagram showing an inner configuration of the electronic clock of a first embodiment of the present invention.

The electronic clock 1 is a radio-controlled timepiece which can calibrate the time by receiving a standard wave. The electronic clock 1 can be a portable watch or a pocket watch, or a table clock or a wall clock.

The electronic clock 1 includes a display section 31 (time display section), a display driver 32 which drives the display section 31, an antenna 33, a radio wave receiving section 34 (receiving section) which receives a radio wave through the antenna 33, a CPU (Central Processing Unit) 41 (a code identifying section 411, a decoding section 412, a consistency confirming section 413, a time calibrating section 414), a ROM (Read Only Memory) 42, a RAM (Random Access Memory) 43, an oscillating circuit 44, a frequency dividing circuit 45, a time keeping circuit 46 (time keeping section), a power source section 47, and an operation section 48.

Among the above, the time information obtaining device is composed of the radio wave receiving section 34 and the CPU 41.

For example, the display section 31 is a digital display section including a liquid crystal display of a dot matrix type and the display driver 32 is a liquid crystal display driver. The display section 31 can use other digital display types such as an organic EL (electro-luminescent) display. The display driver 32 is a display driver which corresponds to the type of display used in the display section 31. Alternatively, the electronic clock 1 can be an analog display type electronic clock including a rotating pointing section such as a plurality of needles as the display section 31.

The antenna 33 and the radio wave receiving section 34 receive a radio wave with a long wavelength range, amplify and detect an amplitude modulated wave and demodulates a signal from the standard wave including time information. The radio wave receiving section 34 is configured to be able to synchronize with the selected reception frequency from among the plurality of frequencies of the standard wave.

The CPU 41 performs various calculating processing and centrally controls the entire operation of the electronic clock 1. When the electronic clock 1 is started, the CPU 41 reads a control program from the ROM 42 and executes the program. With this, the CPU 41 performs processing regarding continuously counting the time and displaying the time. Moreover, the CPU 41 operates the radio wave receiving section 34 at a regular interval such as once a day to receive the standard wave, and calibrates the time.

Various programs and setting data are stored in the ROM 42. A decoding program to accurately decode and obtain time information from the demodulated standard wave signal is included in the various programs. The ROM 42 includes a model array storage section 42*a* which stores a plurality of model arrays with which a degree of match with the code string showing the digit of one minute unit obtained from three successive frames is calculated.

The RAM 43 provides a work memory space in the CPU 41 and temporarily stores data. The RAM 43 includes a code data storage section 43*a* (storage section) which can store code data for a plurality of decoded frames.

The oscillating circuit 44 is a circuit which generates and outputs a frequency signal, and for example, a crystal oscillating circuit is used. The frequency dividing circuit 45 divides and outputs a signal input from the oscillating circuit 44 to a signal with a frequency used in each section such as the CPU 41 and the time keeping circuit 46. The time keeping circuit 46 counts the number of times a predetermined frequency signal is input from the frequency dividing circuit 45 and adds the number to a preset initial time to count the present time.

The power source section 47 supplies predetermined electric power necessary for the operation of the CPU 41 and the display driver 32. For example, the power source section 47 includes a solar battery or a secondary battery and can supply electric power continuously for a long period of time.

The operation section 48 includes a pressing button or a winding crown to receive operation from outside. The received operation is converted to an electric signal, and the electric signal is output to the CPU 41.

Next, the process of obtaining the time information from the standard wave signal in the electronic clock 1 of the present embodiment is described.

In the example described below, the time information is obtained from the standard wave signal of JJY. However, time information can also be obtained from other standard wave signals by selecting and using a suitable encoding format.

According to JJY, the time information is represented by three types of codes showing "0", "1", and "P" (time code) in an array according to a predetermined format, and the code is modulated and transmitted. The three types of codes are distinguished according to the length of the term with a large amplitude (high level term) which is started synchronized with the start of the timing of each second (second synchronizing point). In other words, the code "0" is shown when a term with a large amplitude continues for 0.8 seconds and then a term with an amplitude of 10% of the above amplitude (low level term) continues for 0.2 seconds. The code "1" is shown when a term with a large amplitude continues for 0.5 seconds and then a term with an amplitude of 10% of the above amplitude continues for 0.5 seconds. The code "P" is shown when a term with a large amplitude continues for 0.2 seconds and then a term with an amplitude of 10% of the above amplitude continues for 0.8 seconds. Therefore, by identifying the length of the term with the large amplitude or the timing when the amplitude changes to the small amplitude, it is possible to read which code is shown. 60 codes showing 60 seconds for 1 frame are obtained and the arranged code string is decoded to obtain the time information.

FIG. 2A to FIG. 2E are diagrams describing a code array of data of 1 frame of JJY, and diagrams describing a method of identifying the code based on data of a plurality of frames.

As shown in FIG. 2A, in JJY, the code "P" is transmitted at a timing when the value of the digit of the one second unit is "9" and at a fixed timing as a marker showing the start of each minute (00 seconds). The codes "0" and "1" transmitted in other portions show the time information according to the position and array. The portion showing the time information is divided into blocks showing digit of ten minute unit, digit of one minute unit, digit of ten hour unit, digit of one hour unit, digit of hundred day unit, digit of ten day unit, digit of one day unit, and day of week, and extended blocks for future use such as parity data for checking data, information showing when a leap second is inserted, and summer time information. In these blocks, the value of each digit is shown by the array (code string portion) of the one bit code data by the above codes "0" and "1". For example, the time information regarding the value of the digit of one minute in a certain minute of the time is shown by an array of four pieces of code data transmitted in five to eight seconds of every minute.

When such array of codes are decoded to obtain time information, if a misidentified code is included in the frame, the decoded and obtained time information may also be inaccurate. Therefore, in the electronic clock 1, after obtaining the time information of a plurality of frames, the pieces of time information are compared to confirm the consistency and it is judged whether a misidentified code is erroneously included in the data of each frame.

As shown in FIG. 2A, even if there is an inconsistency in the code of the extended block, there is no influence on the obtained time. Therefore, when the consistency is confirmed, the consistency is not necessarily demanded for all sixty codes.

When the consistency of the time information obtained a plurality of times is confirmed, the electronic clock 1 of the present embodiment obtains one of the time information as the confirmation target based on the data of the plurality of frames. Specifically, among a predetermined number of frames, for example 3 frames of code string data, the majority is determined among the three codes identified as the same position in each frame, and the selected code string is generated with the selected code of each position. With this majority code string, it is possible to obtain time information in which the influence of up to a few pieces of erroneous code data for each frame is eliminated.

In the example described below, code string data of 3 frames is obtained from 11:00 to 11:02 on Oct. 15, 2010.

As described in FIG. 2B, first, among the 60 codes identified from the signal obtained in the range of 11:00 on Oct. 15, 2010, one code (p) of 52 seconds is misidentified. Next, as shown in FIG. 2C, among the 60 codes identified from the signal obtained in the range of 11:01, code (q) of 21 seconds and code (r) of 34 seconds are misidentified. As shown in FIG. 2D, among the 60 codes identified from the signal obtained in the range of 11:02, code (s) of 15 seconds and code (t) of 41 seconds are misidentified.

When a majority is determined among the code data of the same position for 56 codes excluding the 4 codes of 5 to 8 seconds showing the digit of one minute unit (majority selected code string portion) based on the code string data of 3 frames, as shown in FIG. 2E, all code data are correctly selected including the code of the second with the codes (p) to (t) misidentified once each. When the misidentified code randomly occurs in 1 frame, if the errors in 1 frame are a few, the possibility that the code is misidentified in the same code position in 2 frames out of 3 frames is adequately low. Therefore, even when it is not possible to obtain accurate time information in a single frame, it is possible to promptly obtain accurate time information. If by any chance there is an error in the result of the majority, the consistency with the time information obtained from another piece of frame data is confirmed later. Therefore, the possibility that the erroneous time information is obtained as final is even lower. Therefore, similar to when the consistency is confirmed among single frames, it is possible to obtain time information without the accuracy reducing.

The array of 4 codes (code string portion) showing the digit of one minute unit changes for each minute among the 3 frames. Therefore, it is not possible to determine by simply the majority as described above. In the electronic clock 1 of the present embodiment, a model array (model code string) arranging in order a total of 12 codes showing an array of the value of the digit of the one minute digit which may appear in successive three minutes, in other words, a model array of 10 patterns in which the value of the digit of one minute unit is any of 0 to 9 in the first frame is stored in advance in the model array storage section 42*a*. Then, the degree of match, in other words, the number of matching codes between the array of 12 codes actually identified (identified code string) and each model array is calculated. The value of the one minute digit according to the model array with the most matching codes or the code string (matching selected code string portion) corresponding to the one minute value is determined as the digit of one minute unit of the time identified from the code string of the 3 frames. The value of the digit of one minute unit corresponding to the time information may be determined to be any one of the time information of the 3 frames, however, the time information to be employed is set in advance.

FIG. 3A to FIG. 3J are charts showing a model array pattern of a code showing a digit of one minute unit for 3 frames.

As shown in FIG. 2B to FIG. 2D, when the value of the digit of one minute unit is 0 minute, 1 minute, 2 minutes, the array of codes showing the digit of one minute unit throughout the 3 frames is "(0, 0, 0, 0), (0, 0, 0, 1), (0, 0, 1, 0)". If the degree of match between the above array and the model array of 10 patterns shown in FIG. 3A to FIG. 3J is obtained, there is a complete match with the array of 12 codes in the pattern of 0 to 2 minutes as shown in FIG. 3A. Therefore, the value of the digit of one minute unit in the above three minutes is identified as 0 to 2 minutes.

Here, when there are 2 misidentified codes among the 12 codes, it may not be possible to obtain the correct value of the digit of one minute unit. Therefore, it is possible to obtain accurate time information up to 1 error code among 12 codes, in other words, at the same frequency of errors as 4 error codes among 56 codes.

It is possible to set the configuration so that in the following cases, the time information is considered invalid due to too many errors, and to perform the processing of obtaining the time information again from the beginning. Such cases are, when there are 2 or more codes out of 12 codes which do not match between the identified code array and the model array with the highest degree of match, when the result of the majority is two to one in a predetermined number of codes or more among the other 56 codes, and when there are codes where all three codes identified in the same position are different.

As shown in FIG. 3I and FIG. 3J, when the value of the digit of one minute unit of the first frame is 8 or 9, the digit is carried, and not only the digit of one minute unit but also the code array showing the digit of ten minute unit changes within the 3 frames. In other words, the majority does not properly function in the code data showing the digit of ten minute unit also. In such case, in order to prevent the determination of the majority from being performed in the 3 frames where the digit is carried, the time information obtaining processing can be simply paused to adjust the timing of obtaining the 3 frames, or it is possible to suitably switch the order between the 3 frames where the majority is determined and the other 2 frames when time information is obtained by only 1 frame. For example, when the values of the digit of one minute unit of the first 3 frames are identified as "8", "9", and "0", the data of the first 2 frames can be deleted and the data can be obtained again starting from the third frame, or the obtained data of the first and second frame can be switched to single frame data and the selection of the code by majority and obtaining the time information can be performed with data of 3 frames starting from the third frame.

Next, the process of time information obtaining processing in the electronic clock 1 of the present embodiment is described.

Figure 4:
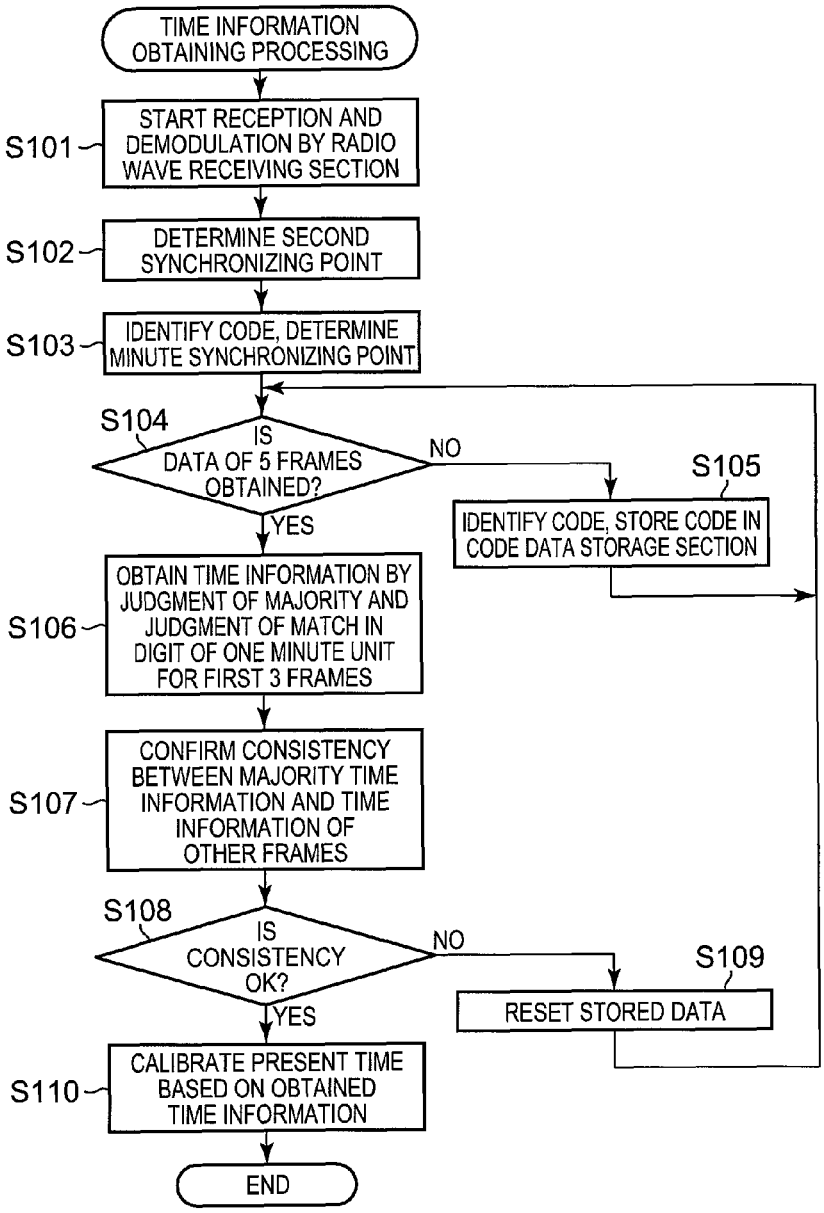
FIG. 4 is a flowchart showing a control process of time information obtaining processing of a first embodiment.

FIG. 4 is a flowchart showing a control process of the time information obtaining processing performed by the CPU 41.

For example, the time information obtaining processing is processing which is automatically started at a preset time or processing which is started based on input operation to the operation section 48 by the user.

When the time information obtaining processing is started, the CPU 41 operates the radio wave receiving section 34, receives the standard wave, demodulates the signal, and obtains the demodulated standard wave signal (step S101).

Next, the CPU 41 determines the second synchronizing point from the obtained standard wave signal (step S102). As the method of determining the second synchronizing point, it is possible to use various well known methods. For example, in the time information obtaining processing, the CPU 41 adds digital data sampled at a temporal resolution (for example, 32 Hz) high enough for the length (one second) of each code for each piece of data at a same phase in a cycle of one second. As a result, the CPU 41 is able to identify the point in which the change of the strength of amplitude of the signal from the low level to the high level is most drastic as the second synchronizing point. The sampled digital data can be binary data or multi-valued data.

When the second synchronizing point is identified, the CPU 41 sequentially identifies the code from the signal of each second. Then, the CPU 41 detects the point where the code "P" continues two times and confirms the timing of the start of 0 second of each minute (minute synchronizing point) (step S103). As the method of identifying the code here, various well known methods can be used. For example, in the time information obtaining processing, the CPU 41 obtains the average amplitude strength of each term by adding and averaging data of 0.2 seconds to 0.5 seconds from the second synchronizing point and data of 0.5 seconds to 0.8 seconds from the second synchronizing point among the data sampled at the above high temporal resolution. Then, the CPU 41 identifies the code based on whether the average amplitude strength is closer to the low level or the high level.

When the minute synchronizing point is detected, the CPU 41 judges whether the code string data of a predetermined number of frames (here, 5 frames) is obtained (step S104). When it is judged that a predetermined number of frames of code string data is not yet obtained (step S104, "NO"), the CPU 41 obtains the signal of the next second, identifies the code, and stores the identified code corresponded with the value of the second in the code data storage section 43*a* (step S105). Then, the processing of the CPU 41 returns to step S104.

When it is judged that a predetermined number of frames of code string data is obtained (step S104, "YES"), the CPU 41 judges the majority among the three codes identified in each second excluding the data portion showing the digit of one minute unit (5 seconds to 8 seconds) for the code string data of the first 3 frames from the code string data of the obtained 5 frames. Then, the CPU 41 selects the code of the majority and obtains the time information based on the code string data generated as a result of the above (step S106). The CPU 41 calculates the degree of match between the code string of 12 codes consisting of the 4 codes showing the digit of one minute unit identified in 3 frames arranged in the order of reception and the code string of 10 patterns stored in the model array storage section 42*a*. Based on the 3 values of the digit of one minute unit shown by the matching (most similar) code string, the CPU 41 determines the value of the digit of one minute unit of the obtained time information.

The processing of step S106 can be performed for the code when each code of the third frame is identified, or the block each time the time information of each block is obtained. Alternatively, the processing of step S106 can be performed parallel with the processing of receiving the signal and identifying the code of the remaining 2 frames.

The CPU 41 obtains the time information from the code array of the remaining 2 frames, and the CPU 41 confirms the consistency between the obtained two pieces of time information and majority time information obtained in the processing of step S106 (step S107). Next, the CPU 41 judges whether the result of the confirmation shows that there is consistency (step S108). When it is judged that there is no consistency (step S108, "NO"), the CPU 41 resets the data with no consistency (step S109) and then returns the processing to step S104 to repeat the processing (step S104 to step S108). Here, the code string data of all 5 frames can be reset or if the code string data of only one frame is not consistent, then only the code string data of the frame which is inconsistent can be reset. Alternatively, the code string data of the oldest frame can be reset.

When it is judged that there is consistency (step S108, "YES"), the CPU 41 sets the present time based on the time information with consistency, and the present time of the time keeping circuit 46 is overwritten and calibrated (step S110). Then, the CPU 41 ends the time information obtaining processing.

The electronic clock 1 of the present embodiment includes a radio wave receiving section 34 which receives a standard wave and which demodulates a signal including time information from the standard wave. The CPU 41 identifies the second synchronizing point and the minute synchronizing point from the demodulated signal to identify the code string of each frame. The CPU 41 also confirms the consistency of the time information regarding the code string identified a plurality of times, and when the consistency is confirmed, the time information obtained by decoding the code string is acquired. Here, one of the code strings among the plurality of code strings which is to be the target of confirmation of consistency is to be the selected code string generated based on the code string identified a plurality of times, for example, 3 times. As for the code string portion of the digit of one minute unit which changes each time among the 3 code strings (codes of 5 seconds to 8 seconds), the CPU 41 determines the selected code string based on the degree of match between the model code array which is the array of the code possible by the digit of one minute unit in the 3 code strings and the identified code array consisting of 12 codes arranging the code string portion identified 3 times. As for the portion other than the code string portion of the digit of one minute unit, the selected code string is determined by a majority among the 3 codes identified to be in the same position in the 3 code strings.

By performing such confirmation processing of consistency, even if the receiving condition is not good to a degree that misjudgment of the code occurs in many frames, the time data can be obtained without the accuracy of the obtained time reducing.

By suitably adjusting the term for generating the code string by majority, it is possible to obtain the time information including cases where the receiving sensitivity or S/N ratio is low without making the receiving time longer than necessary.

Since the code string is generated by majority avoiding cases where the digit of one minute unit is carried to the digit of ten minute unit, it is possible to generate a code string with only the combination of the judgment of the degree of match of the digit of one minute unit and generating the code string by majority for all of the other portions. Therefore, excess load is not applied to the CPU 41 due to detailed conditions and there is no need to increase the storage capacity of the ROM 42 or the RAM 43 to be used.

Moreover, each of the identified code string data is temporarily stored in the code data storage section 43*a*. Therefore, when the code string is generated by majority, it is possible to easily change to a suitable combination of the frame. Moreover, instead of the data obtained in the high sampling frequency used in identifying the second synchronizing point and the code, only the identified code is stored. Therefore, there is no need for space and processing to store a large amount of data.

By providing the above time information obtaining device in a clock, specifically a portable watch, it is possible to suppress increase of load on the operation of the clock, to maintain continuous and stable operation for a long period of time, and to make the clock smaller and lighter without the need of high load.

Second Embodiment

Next, the electronic clock 1 of the second embodiment is described.

In the electronic clock 1 of the second embodiment, only the content of the time information obtaining processing is different from the electronic clock 1 of the first embodiment and the configuration is the same. Therefore, the same reference numerals are applied and the description is omitted.

Next, the time information obtaining processing of the electronic clock 1 of the second embodiment is described.

Figure 5:
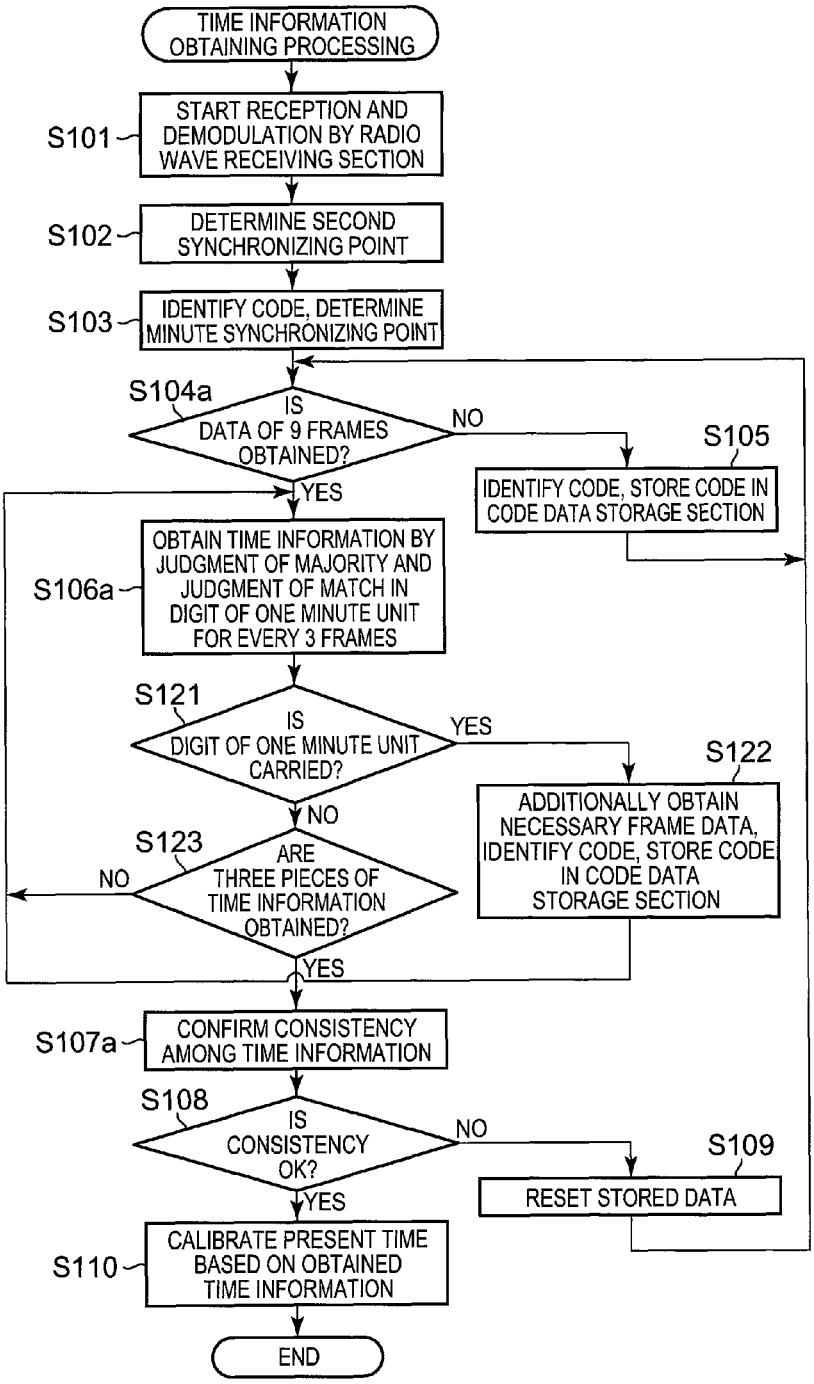
FIG. 5 is a flowchart showing a control process of time information obtaining processing of a second embodiment.

FIG. 5 is a flowchart showing a control process of the time information obtaining processing performed by the CPU 41 in the electronic clock 1 of the second embodiment.

The time information obtaining processing of the second embodiment is the same as the time information obtaining processing of the first embodiment, other than the points of the processing of steps S104, S106, and S107 of the time information obtaining processing of the first embodiment being replaced by the processing of steps S104*a*, S106*a*, and S107*a*, and the processing of steps S121 to S123 being added after the processing of step S106*a*. The same reference numerals are applied to the same processing and the detailed description is omitted.

When the minute synchronizing point is determined in the processing of step S103, until it is judged that the data for 9 frames is obtained (step S104*a*), the CPU 41 obtains the signal for each code, identifies the code and stores the code in the code data storage section (step S105).

When it is judged that the data for 9 frames is obtained (step S104*a*, "YES"), the CPU 41 performs the processing of selecting each code by majority in order for each 3 frames, and selecting the value of the digit of one minute unit by matching judgment (step S106*a*). When one piece of time information is obtained, the CPU 41 judges whether the obtained time information includes a carried digit (step S121). Then, when it is judged that the carried digit is included (step S121, "YES"), additional frame data is obtained to obtain the time information excluding this portion (step S122). Specifically, when the digit of one minute unit of the obtained time information is "8", "9", "0", data of 2 frames is additionally obtained. When the digit of one minute unit of the obtained time information is "9", "0", "1", the data of 1 frame is additionally obtained. Then, the processing of the CPU 41 returns to step S106*a*, and the time information is obtained again using the code string data of 3 frames from the data of the "0" minute range.

When it is judged that there is no carried digit (step S121, "NO"), then, the CPU 41 judges whether the time information is obtained 3 times (step S123). When it is judged that the time information is not obtained 3 times (step S123, "NO"), the processing of the CPU 41 returns to step S106*a* and the time information is obtained using the code string data of the next 3 frames.

When it is judged that time information is obtained 3 times (step S123, "YES"), the CPU 41 confirms the consistency among the three pieces of time information, all of which is determined by judgment of majority and matching (step S107*a*). Then, the processing of CPU 41 advances to step S108 and judges whether the consistency is satisfied.

As described above, the electronic clock 1 of the second embodiment obtains 3 pieces of time data from the code value selected by majority among the code data of the code string data of 3 frames and matching judgment of the value of the digit of one minute unit, and then performs confirmation of consistency among the time information to obtain accurate time information. Therefore, even in cases where it is not possible to confirm the consistency by conventional methods due to misjudgment of the code included in the 60 codes for each frame, it is possible to confirm consistency without reducing the accuracy of the time information.

Moreover, since the code string used in the majority judgment are all code strings from different frames, it is possible to avoid using the code string of the frame with poor receiving status repeatedly in the plurality of majority code strings.

The present invention is not limited to the above described embodiments and various modifications are possible.

For example, according to the above embodiment, data of 3 frames are obtained to judge by majority, however it is not necessary to fix the number of frames received and obtained. For example, if the data completely matches when data of 2 frames are obtained, there is no need to obtain data of the third frame. Similarly, when the majority is judged by code string data of 5 frames, if the result of the majority is determined when the third or fourth frame of the code string data is obtained, the processing can be configured to not receive the code string data of the remaining frames and to not identify each code.

Moreover, in the above described embodiments, when the value of the digit of one minute unit is carried, the data of the plurality of frames which is the target of majority judgment is always obtained again or the combination is always changed. However, when there is allowance in the calculating capability of the CPU 41 and the memory capacity of the RAM 43, it is possible to omit the code array showing the digit of ten minute unit from the target of selection by majority judgment, and judgment of the degree of match can be performed for the code array showing the digit of ten minute unit and the digit of one minute unit.

When all pieces of data of 3 frames match without judgment by majority, it is possible to judge that the consistency of the time information obtained by one of the normal frame data is confirmed, and the data of the remaining 2 frames do not need to be received.

Whether to obtain all of the time information using the majority of the code string of the plurality of frames or obtaining a portion of the time information from only 1 frame data can be switched according to the receiving level. For example, processing to judge the noise level (S/N ratio) can be performed when the processing to identify the second synchronizing point is performed, and it is possible to judge whether to obtain the time information using the majority judgment when the processing to identify the code starts.

The processing to confirm the consistency can be performed among the pieces of time information after the time information is decoded from the code string data or the processing can be performed with the code string data as is.

When the code string data, which corresponds to each of the plurality of pieces of time information which is the target of confirming consistency, is identified using the majority judgment, the frame data used in such majority judgment can be repeatedly used in some portions. For example, time information obtained from the code string determined by performing majority judgment using the frame data with the digit of one minute unit showing "1", "2", and "3" and time information obtained from the code string determined by performing majority judgment using the frame data with the digit of one minute unit showing "3", "4", and "5" can be included in the time information which is to be the target of confirming consistency.

According to the above embodiment, the list data of the model code string used in the judgment of the degree of match of the digit of one minute unit is stored in advance in the model array storage section 42*a*. However, it is possible to generate the model code string each time as necessary when the program is performed. By generating the model code string each time, it is possible to flexibly handle the following cases to obtain the time information, for example, cases such as when the matching judgment of the value of the digit of one minute unit is performed using the code string data of a plurality of minutes which are not consecutive or when the number of the code string used in the judgment is variable.

Although various exemplary embodiments have been shown and described, the invention is not limited to the embodiments shown. Therefore, the scope of the invention is intended to be limited solely by the scope of the claims that follow and its equivalents.

The entire disclosure of Japanese Patent Application No. 2012-169786 filed on Jul. 31, 2012 including specification, claims, drawings and abstract are incorporated herein by reference in its entirety.

What is claimed is:

1. A time information obtaining device comprising:

a receiving section which receives a radio wave including time information and which demodulates a signal from the received radio wave;

a code identifying section which identifies a code string showing the time information from the signal demodulated by the receiving section;

a decoding section which decodes the identified code string to obtain time information;

a consistency confirming section which confirms consistency of time information shown in a plurality of code strings decoded by the decoding section, wherein:

at least one of the plurality of code strings with which consistency is confirmed by the consistency confirming section is a selected code string generated by code strings consisting of a predetermined number which is at least 3 identified by the code identifying section;

the consistency confirmation section confirms consistency of the plurality of code strings with the selected code string and another code string identified by the code identifying section;

the consistency confirming section generates the selected code string using the following:

(i) a matching selected code string portion in which, among the predetermined number of code strings, for a code string portion set in advance including a code which may change among code strings according to the time information of the code string, a type of code of a code string portion is selected based on a degree of match between an identified code string arranging the predetermined number of code string portions, and each of a model code string which is an array of the predetermined number of code string portions which are possible arrays as the identified code string; and (ii) a majority selected code string portion in which, among the predetermined number of code strings, for a portion other than the code string portion set in advance, a type of code is selected by majority determination among the predetermined number of codes identified to be a same position in the code string;

the consistency confirming section includes a matching selected code string portion judging section which judges whether the array of the matching selected code string portion includes carrying to a digit of a ten minute unit; and when the matching selected code string portion judging section judges that carrying to a digit of a ten minute unit is included, the consistency confirming section resets a combination of the predetermined number of code strings so as not to include carrying to a digit of a ten minute unit to generate the selected code string.

2. The time information obtaining device according to claim 1, wherein, the code string portion set in advance is a code string portion showing time information regarding a digit of a one minute unit of time.

3. The time information obtaining device according to claim 2, wherein, all of the plurality of code strings with which consistency is confirmed by the consistency confirming section are selected code strings.

4. The time information obtaining device according to claim 3, wherein, each code of the plurality of selected code strings are each selected based on different code strings identified separately by the code identifying section.

5. The time information obtaining device according to claim 2, further comprising:

a storage section which stores the code string identified by the code identifying section, wherein the consistency confirming section generates the selected code string and confirms consistency of the time information shown in the plurality of code strings using the code strings stored in the storage section.

6. A radio-controlled timepiece comprising:

a time information obtaining device according to claim 2;

a time keeping section which counts present time;

a time calibrating section which calibrates the present time counted by the time keeping section based on time information obtained by the time information obtaining device; and a time display section which displays the counted present time.

7. The time information obtaining device according to claim 1, wherein, all of the plurality of code strings with which consistency is confirmed by the consistency confirming section are selected code strings.

8. The time information obtaining device according to claim 7, wherein, each code of the plurality of selected code strings are each selected based on different code strings identified separately by the code identifying section.

9. The time information obtaining device according to claim 8, further comprising:

a storage section which stores the code string identified by the code identifying section, wherein the consistency confirming section generates the selected code string and confirms consistency of the time information shown in the plurality of code strings using the code strings stored in the storage section.

10. The time information obtaining device according to claim 7, further comprising:

a storage section which stores the code string identified by the code identifying section, wherein the consistency confirming section generates the selected code string and confirms consistency of the time information shown in the plurality of code strings using the code strings stored in the storage section.

11. The time information obtaining device according to claim 1, further comprising:

a storage section which stores the code string identified by the code identifying section, wherein the consistency confirming section generates the selected code string and confirms consistency of the time information shown in the plurality of code strings using the code strings stored in the storage section.

12. A radio-controlled timepiece comprising:

a time information obtaining device according to claim 1;

a time keeping section which counts present time;

a time calibrating section which calibrates the present time counted by the time keeping section based on time information obtained by the time information obtaining device; and a time display section which displays the counted present time.

* * * * *